US005379989A

United States Patent [19]

Heaslip et al.

[11] Patent Number: 5,379,989

[45] Date of Patent: Jan. 10, 1995

[54] TUNDISH WITH IMPROVED FLOW CONTROL

[75] Inventors: Lawrence J. Heaslip; James D. Dorricott, both of Ontario, Canada

[73] Assignee: Premier Refractories and Chemicals Inc., King of Prussia, Pa.

[21] Appl. No.: 111,306

[22] Filed: Aug. 24, 1993

Related U.S. Application Data

[60] Division of Ser. No. 934,296, Aug. 24, 1992, Pat. No. 5,246,209, which is a continuation of Ser. No. 691,142, Apr. 25, 1991, abandoned.

[51] Int. Cl.[6] ..... C21B 3/00

[52] U.S. Cl. ..... 266/229; 266/275

[58] Field of Search ..... 266/275, 236, 227, 229, 266/45; 222/594

[56] References Cited

U.S. PATENT DOCUMENTS

| | | | |
|---|---|---|---|
| 4,789,140 | 12/1988 | Lirones | 266/229 |
| 5,064,175 | 11/1991 | Soofi | 266/229 |
| 5,246,209 | 9/1993 | Heaslip et al. | 266/229 |

*Primary Examiner*—Scott Kastler

*Attorney, Agent, or Firm*—Ostrolenk, Faber, Gerb & Soffen

[57] ABSTRACT

A tundish includes first and second flow control walls which define a flow receiving space. A plurality of outlets are located in the bottom of the tundish and toward the front thereof. Each flow control wall includes a plurality of openings located closer to the back of the tundish than toward the front and located closer to the bottom of the flow control wall than the top thereof.

9 Claims, 3 Drawing Sheets

TUNDISH WITH IMPROVED FLOW CONTROL

This is a division of application Ser. No. 07/934,296, filed Aug. 24, 1992 now U.S. Pat. No. 5,246,209, which is a continuation of application Ser. No. 07/691,142, filed Apr. 25, 1991, now abandoned.

BACKGROUND OF THE INVENTION

1. Field of the Invention

The present invention relates to a device for controlling the flow of liquid metal, particularly a tundish for directing liquid metal from a ladle to a plurality of molds in a continuous casting process.

2. Description of the Related Art

When liquid metal is poured from a ladle normally containing only a single outlet into a multiple number of molds, an intermediate vessel called a tundish is required to distribute the metal between these molds. Practical considerations, such as, ease of installation and repair of the refractory lining of the tundish to the relationship of the tundish to the molds and secondary cooling apparatus, indicate the requirement for a simple tundish shape which can supply metal at a nearly constant rate to molds which are arranged along a single axis.

In the prior art, a very simple tundish consisting of either a trough or box shaped vessel having a generally horizontal or flat bottom with walls is commonly used. In these designs, the stream pouring from the ladle enters the tundish in a position adjacent to one or more of the tundish nozzle outlets, generally on or close to the axis which adjoins the tundish nozzle centers. The problems encountered with these tundish arrangements include:

1. Thermal nonhomogeneity in the liquid metal contained in the tundish. This results in tundish exit streams having different temperatures with the colder metal exiting the nozzle furthest from the ladle stream and hotter metal exiting from the streams closest to the ladle stream.

2. Short-circuit flow and different liquid metal residence time distributions associated with each tundish to mold stream.

3. Turbulence within the tundish caused by the dissipation of the kinetic energy in the ladle streams. The turbulence is propagated above adjacent tundish nozzles and disturbs the smooth flow which is required to properly fill the molds.

4. This turbulence and the pattern of liquid metal flow within the tundish does not allow the separation by floatation of buoyant slag and inclusion particles entrained within the liquid metal.

5. The pattern of flow generated within the tundish can include stagnant or dead flow regions indicating that the input energy from the incoming ladle stream is not properly distributed.

More complex tundish geometries have been used with the objective of allowing the ladle stream entry position to be displaced away from the axis joining the tundish exit-nozzle centers in order to alleviate some of the above problems. These include T-shape and Delta-shape tundish designs. These designs are partially effective at reducing the problems associated with turbulence by moving the turbulent region further away from the exit nozzle positions. However, this can exacerbate problems associated with stagnant regions, thermal homogeneity, short-circuit flow patterns, liquid residence distribution, refractory life and repair, and inclusion removal.

Other prior art tundishes are disclosed in U.S. Patents Nos. 4,711,429, 4,671,499, 4,653,733, 4,177,855 and 4,042,229. Some of these have only been used for limited purposes, such as for mixing alloys with different specific gravities. None of the tundishes can solve all of the problems of stagnant regions, thermal nonhomogeneity, short-circuit flow patterns, liquid residence distribution, refractory life and repair and inclusion removal.

SUMMARY OF THE INVENTION

Thus, an object of the present invention is to provide a tundish which is uncomplicated, and which solves the foregoing problems.

This object and others are accomplished by a tundish having a bottom wall, a front wall and a back wall, the bottom wall having an outlet. A flow control wall is arranged in the tundish to define a flow receiving space. The flow control wall extends from the front wall to the back wall and includes (1) a passageway for allowing flow from the flow receiving space to the outlet, the passageway being closer to the back wall then to the front wall, and being closer to a bottom of the flow control wall than a top thereof and (2) means for preventing flow from the flow receiving space to the outlet except through the passageway.

Preferably, there are two flow control walls which are spaced to define a flow receiving space in which turbulence is contained and a localized mixing zone is promoted. Additionally, flow within the tundish is not sensitive to the ladle pouring position nor to the vertical impingement of the incoming ladle pouring stream.

Other features and advantages of the present invention will become apparent from the following description of the invention which refers to the accompanying drawings.

DETAILED DESCRIPTION OF THE PREFERRED EMBODIMENTS

Figure 1:
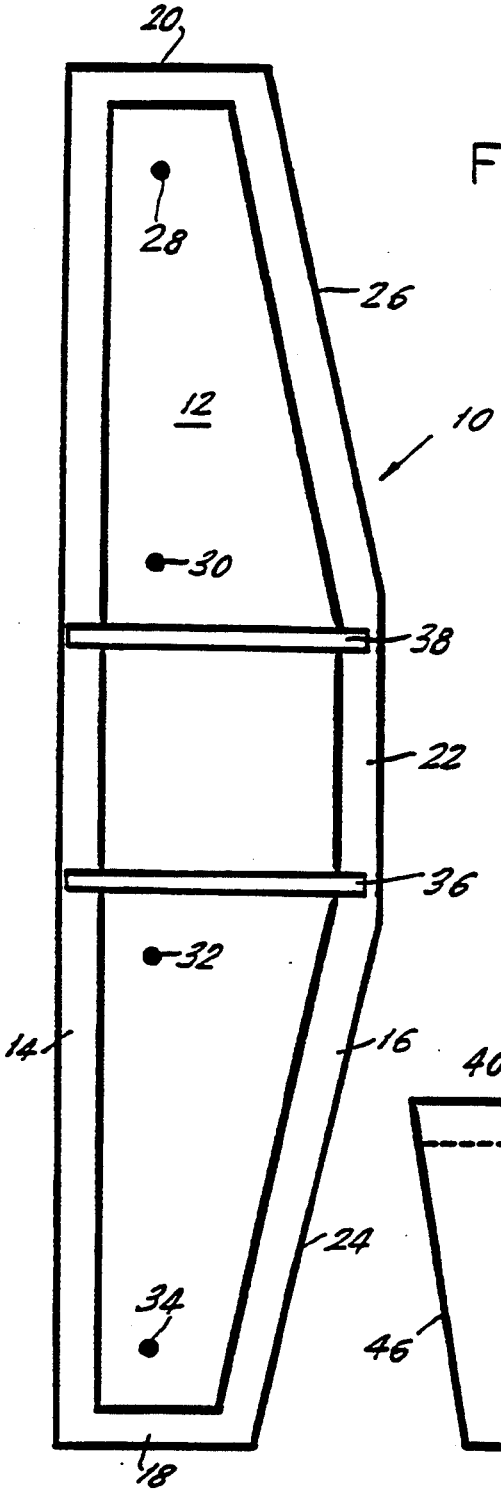
FIG. 1 is a top view of a tundish in accordance with the present invention.

Referring now to the drawings, there is shown in FIG. 1 a tundish which is constructed in accordance with the principles of the present invention and which is indicated generally by reference numeral 10.

The tundish 10 has a bottom wall 12, a front wall 14, a back wall 16, and end walls 18 and 20. The back wall 16 is delta shaped such that a middle region 22 of the back wall 16 is spaced farther away from the front wall 14 than the lengths of the endwalls 18 and 20. The middle portion 22 is generally parallel to the front wall 14 and is connected to the endwalls 18, 20 by angled portions 24, 26, respectively.

There are a plurality of outlets 28, 30, 32 and 34 through the bottom wall 12. The purpose of the outlets 29–34 is to allow liquid metal to drain from the tundish into a plurality of casting molds (not shown) located generally beneath the outlets 29–34. Four outlets 29–34 are illustrated in FIG. 1, but there may be more or less outlets.

Figure 2:
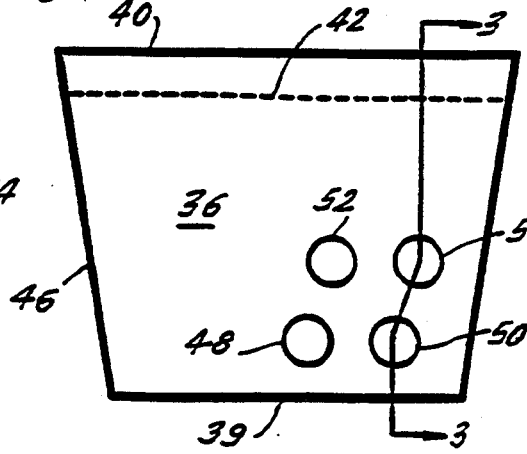
FIG. 2 is a side view of a flow control wall for the tundish of FIG. 1.
Figure 3:
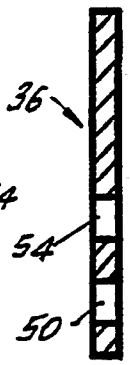
FIG. 3 is a cross-sectional view of the wall of FIG. 2 through the line 3—3.
Figure 4:
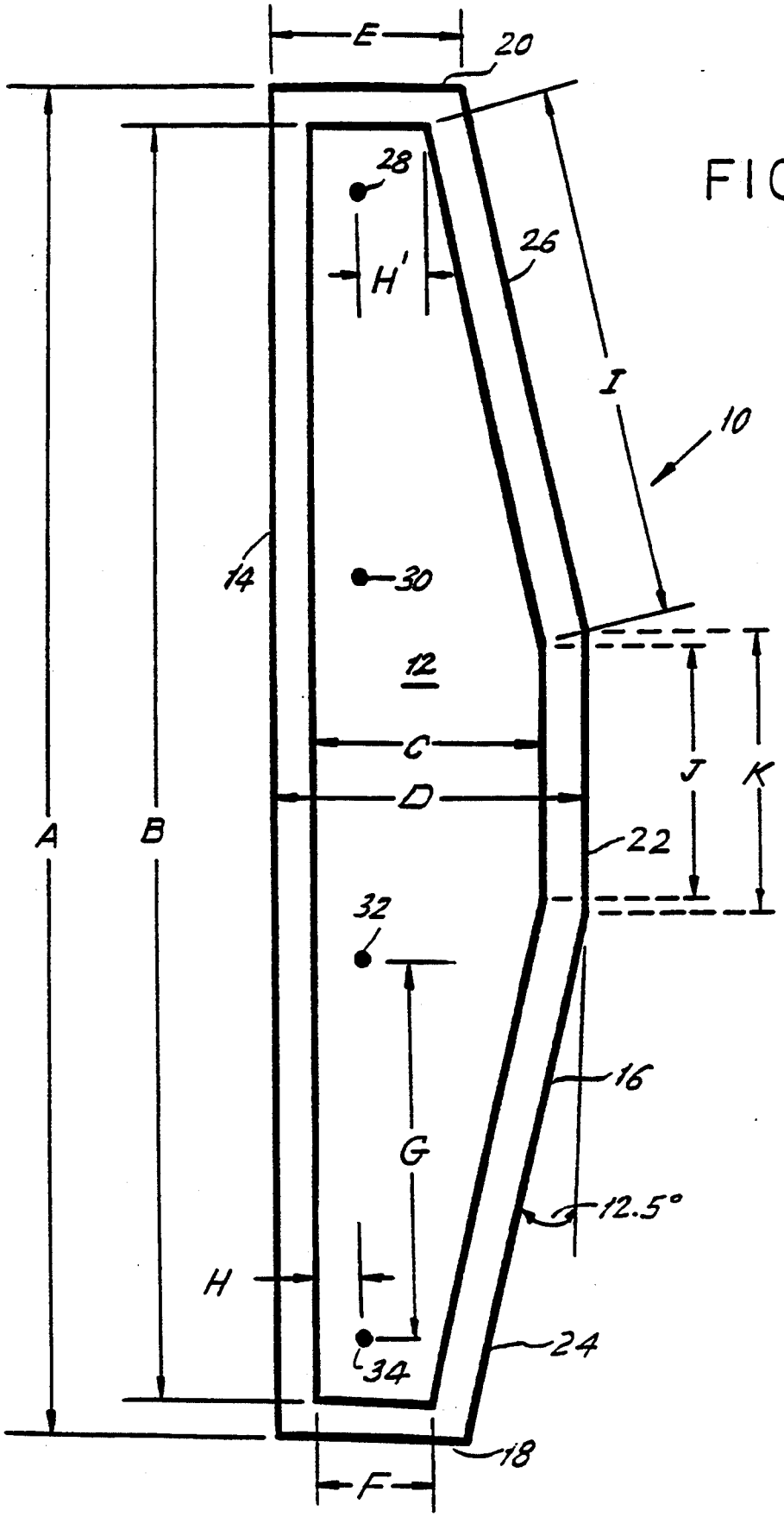
FIG. 4 is another top view of the tundish of FIG. 1 with the flow control walls removed.
Figure 5:
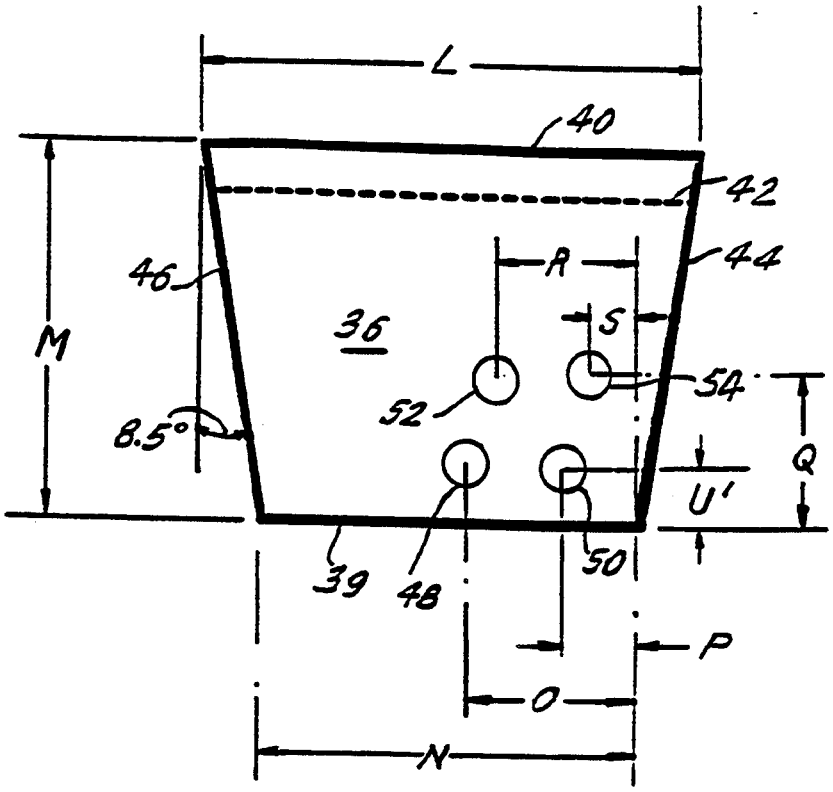
FIG. 5 is another side view of the flow control wall of FIG. 2.

Baffles or flow control wall 36 and 38 are inserted into the tundish and extend from the front wall 14 to the back wall 16. The flow control wall 36 is illustrated in detail in FIG. 2. The flow control wall 36 has a bottom edge 39 and a top edge 40. The top edge 40 is higher than the normal top level 42 of the liquid metal in the tundish 10. This way, floating inclusions and slag between the flow control walls 36, 38 are kept between the flow control walls 36, 38. The side walls 44 and 46 of the wall 36 are angled separate to continuously join the angled front and back walls 14, 16.

A passageway for allowing liquid metal to flow from the flow receiving space to the outlets is located in the lower front quadrant of the flow control wall 36. The other three quadrants of the flow control wall 36 are solid such that liquid metal can flow from the flow receiving space to one or more of the outlets only through the passageway. The passageway itself can be formed in a variety of different ways but it has been found advantageous to have the passageway be angled generally upwardly and toward the front wall 14. Thus, in the embodiment illustrated in FIG. 2, the passageway is formed of four openings 48–54 with the upper holes 52 and 54 being located generally in front of the respective bottom holes 48, 50.

The openings 48–54 should be placed in the lower quadrant of the flow control wall 36 or 38 opposite the quadrant which contains the center line of the tundish outlets 28, 30, 32 and 34. The angling of the openings both upward and toward the front wall is a function of the length of the tundish 10 and the number of openings and is generally in the range of between 0 and 45 degrees. For example, for 2 to 5 openings, the angles of the openings may be from 20 to 45 degrees, and for 6 to 8 openings, the angles may be between 0° and 20°.

The velocity of the flow passing through a flow control wall 36 or 38 must be sufficient to mix the liquid metal on the downstream side of the baffle with an intensity which causes the temperature of the liquid metal to be nearly homogeneous at each point where the liquid metal exits the tundish 10. Excessive velocity, however, will reduce the residence time of the liquid metal within the tundish 10, thereby inhibiting the separation by floatation of large inclusions and entrained slag material passing through a flow control wall. This velocity is directly related to the flow of liquid metal, expressed as the mass flow per unit time (e.g. tons/min) passing through the flow control wall divided by the cross sectional area of the openings of the flow control wall. For example, in a case where 1.0 tons/min of liquid steel are passing through a flow control wall containing 4 openings 48–54, each of four inch diameter, the specific throughput may be calculated as:

$$1.0 \text{ tons/min} / 4 \text{ holes} \times 4\,\pi \text{ sq. in.} = 0.02$$

For the specific throughput of liquid steel in these units, the desired range is 0.015 to 0.025 tons/min/sq. in. The number of strands (i.e. number of tundish outlets) in a tundish determines the optimum value within the range. Six to eight strand tundishes will be optimized at the high end of this range, wherein two to five strand tundishes will be optimized at the lower end. For a desired flow (i.e. tons/min) passing through a flow control wall, this formula allows the desired number of openings of a given size to be easily determined.

The dimensions of the tundish are important in terms of controlling flow as desired.

The separation of the flow control walls 36 and 38 determines the volume of the region in which the momentum of the incoming flow from the ladle is dissipated by turbulence in a tundish 10 of given cross section. The momentum of the inlet flow from the ladle is related to the quantity of the flow (e.g., cu. ft. of liquid metal/min), while the volume of the region is the product of the separation of the flow control walls 36 and 38 and the average cross-sectional area of tundish between the walls 36 and 38 occupied by liquid metal at the normal operating depth. The turbulence intensity factor is calculated, therefore, as follows:

pti tundish inlet flow (cu.ft/min.) average tundish cross-section between flow walls (sq. ft)×flow wall separation (ft.)

A desired range for this factor is 0.28 to 0.36 $\text{min}^{-1}$.

The tundish inlet flow is determined by operational requirements (i.e., the desired through-put of metal). Therefore, for a given tundish cross-section the desired flow control wall separation can be easily determined.

Figure 6:
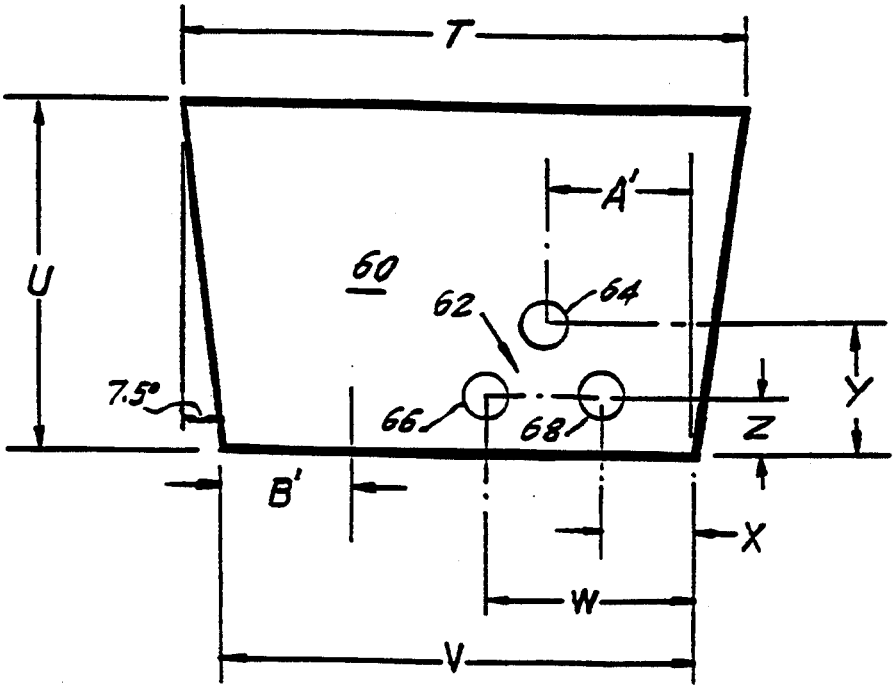
FIG. 6 is a side view of the flow control wall in accordance with another embodiment of the present invention.

Another flow control wall 60 which has proven to be advantageous is illustrated in FIG. 6. The flow control wall 60 is generally similar to the flow control wall 36 in that there is a passageway 62 located in a lower front quadrant and in that the other three quadrants of the flow control wall 60 are solid such that liquid metal can flow from the flow receiving space to an outlet only through the passageway 62. The passageway 62 has a hole 64 which is located generally above and in front of a hole 66, and another hole 68.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a baffle and a tundish, the baffle comprising:

a flow control wall for defining a flow receiving space in the tundish, said flow control wall including a first quadrant and an opposite second quadrant, said flow control wall being disposed in said tundish so that a line extending along the length of said tundish and passing through said second quadrant also passes through an outlet provided in the tundish;

a passageway for allowing flow from said flow receiving space to the outlet of the tundish, the passageway disposed in said first quadrant of said flow control wall, and being closer to a bottom of said flow control wall than to a top thereof; and means for preventing flow from the flow receiving space to the outlet except through said passageway disposed in said first quadrant of said flow control wall.

2. The combination of claim 1, wherein said passageway includes a plurality of openings.

3. The combination of claim 2, wherein each opening is angled both upwardly and toward a wall of the tundish.

4. The combination of claim 1, wherein the tundish is structured and arranged for directing liquid metal from a ladle to a plurality of molds by gravity.

5. The combination of claim 1, wherein said passageway is structured and arranged for passing liquid metal therethrough at a sufficient velocity so that the liquid metal is mixed on the downstream side of said flow control wall at an intensity to cause the temperature of the liquid metal to be substantially homogeneous at the outlet.

6. The combination of claim 5, wherein said passageway is structured and arranged such that the liquid metal passing therethrough is at a sufficient velocity such that inclusions and slag materials in the liquid metal are separated by flotation on the downstream side of said baffle.

7. The combination of claim 5, wherein the size of said passageway is such that the liquid metal flows through said passageway at a velocity in a range of about 0.015 to 0.25 tons/min./sq. in., wherein the velocity is defined as mass flow passing through said passageway (tons/min.) cross-sectional area of said passageway (sq. in.).

8. In combination, a baffle and a tundish, the baffle comprising:

first and second spaced flow control walls for defining a flow receiving space in the tundish, each of said flow control walls including a first quadrant and an opposite second quadrant, each said flow control wall being disposed in said tundish so that a line extending along the length of said tundish and passing through said second quadrant of each said flow control wall also passes through an outlet provided in the tundish;

a passageway for allowing the flow of liquid metal from said flow receiving space to the outlet in the tundish, said passageway disposed in said first quadrant of each said flow control wall, and being closer to a bottom of said flow control wall than to a top thereof; and means for preventing flow from said flow receiving space to the outlet except through said passageway in said first quadrant of each said flow control wall, wherein said passageway is structured and arranged for substantially maximizing the flow path between the flow receiving space and the outlet by the flow of the liquid metal being initially directed from said flow receiving space away from the outlet.

9. The combination of claim 8, wherein the tundish has a turbulence intensity factor defined as flow receiving space flow (cu. ft./min.) average tundish cross-section between said first and second flow control walls (sq. ft.) × said flow control walls separation (ft.)

and wherein the turbulence intensity factor is in the range of about 0.28 to 0.36 $min^{-1}$.

* * * * *